US007304273B2

(12) United States Patent
Kinouchi et al.

(10) Patent No.: US 7,304,273 B2
(45) Date of Patent: Dec. 4, 2007

(54) HEATING DEVICE AND FIXING DEVICE

(75) Inventors: Satoshi Kinouchi, Tokyo (JP); Osamu Takagi, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/495,533

(22) Filed: Jul. 31, 2006

(65) Prior Publication Data

US 2006/0289484 A1 Dec. 28, 2006

Related U.S. Application Data

(60) Continuation of application No. 11/197,452, filed on Aug. 5, 2005, now Pat. No. 7,094,997, which is a division of application No. 10/938,658, filed on Sep. 13, 2004, now Pat. No. 6,936,800, which is a division of application No. 10/382,846, filed on Mar. 7, 2003, now Pat. No. 6,861,630.

(51) Int. Cl.
*H05B 1/02* (2006.01)

(52) U.S. Cl. ..... 219/497; 219/216; 219/492; 399/69

(58) Field of Classification Search ..... 219/619, 219/661, 663, 497, 483–486, 481, 494, 216, 219/492; 399/67, 69, 88, 90
See application file for complete search history.

(56) References Cited

U.S. PATENT DOCUMENTS 5,097,288 A * 3/1992 Akao et al. ..... 355/401
5,204,723 A * 4/1993 Hanada et al. ..... 399/335
6,026,273 A 2/2000 Kinouchi et al.
6,078,781 A 6/2000 Takagi et al.
6,087,641 A 7/2000 Kinouchi et al.
6,292,647 B1 9/2001 Ishida
6,320,168 B1 11/2001 Kimata et al.
6,337,969 B1 1/2002 Takagi et al.
6,377,775 B1 4/2002 Nakayama et al.
6,438,335 B1 8/2002 Kinouchi et al.
6,587,654 B1 7/2003 Nishi
6,643,476 B1 11/2003 Kinouchi et al.
6,643,491 B2 11/2003 Kinouchi et al.
6,724,999 B2 4/2004 Kikuchi et al.
6,725,000 B2 4/2004 Takagi et al.
6,753,515 B2 6/2004 Miyahara et al.

(Continued)

FOREIGN PATENT DOCUMENTS

JP 2-270293 A 11/1990

(Continued)

*Primary Examiner*—Mark Paschall
(74) *Attorney, Agent, or Firm*—Foley & Lardner LLP

(57) ABSTRACT

A CPU detects a temperature of a central part of a heating roller. If the detected temperature does not exceed 180° C., the CPU drives a central coil or a side-end coil for 0.4 second in accordance with a temperature difference between the central part of the heating roller and a side-end part of the heating roller. Then, the CPU drives the side-end coil or central coil for 0.2 second. Thereafter, the CPU detects the temperature of the central part and repeats the driving control until the detected temperature reaches 180° C.

16 Claims, 5 Drawing Sheets

U.S. PATENT DOCUMENTS

| | | | | |
|---|---|---|---|---|
| 6,763,206 | B2 | 7/2004 | Kinouchi et al. | |
| 6,868,249 | B2 | 3/2005 | Kinouchi et al. | |
| 7,082,272 | B2 * | 7/2006 | Takano | 399/69 |
| 2002/0007752 | A1 | 1/2002 | Sakagami | |

FOREIGN PATENT DOCUMENTS

| | | | |
|---|---|---|---|
| JP | 2000-206813 | A | 7/2000 |
| JP | 2001-312178 | A | 11/2001 |

* cited by examiner

HEATING DEVICE AND FIXING DEVICE

The present application is a continuation of U.S. application Ser. No. 11/197,452, filed Aug. 5, 2005, now U.S. Pat. No. 7,094,997, which is a divisional of U.S. application Ser. No. 10/938,658, filed Sep. 13, 2004, now U.S. Pat. No. 6,936,800, which is a divisional of U.S. application Ser. No. 10/382,846, filed Mar. 7, 2003, now U.S. Pat. No. 6,861,630, the entire contents of which are incorporated herein by reference.

BACKGROUND OF THE INVENTION

The present invention relates to a heating device using induction heating. In particular, this invention relates to a fixing device for fixing a toner image using a heating device in an electrophotographic copying apparatus or printer apparatus using a toner as a visible-image forming agent.

In a conventional fixing device incorporated in a copying apparatus using an electrophotographic process, a developer or a toner formed on an image-fixation medium is heated and fused and the toner is fixed on the image-fixation medium. Well-known toner heating methods applicable to the fixing device include a method using radiation heat obtained by turning on a filament lamp and a flash heating method using a flash lamp as a heat source.

In recent years, a fixing device using an induction heating device as a heat source has been proposed.

Jpn. Pat. Appln. KOKAI Publication No. 2-270293 discloses an induction heating device with two induction coils, which includes a plurality of inverter circuits and a detection circuit that detects a zero point of an AC power supply, wherein when switching elements of the inverter circuits are switched (i.e. driving of coil A is switched to driving of coil B), the switching is effected at the zero point of the AC power supply.

Jpn. Pat. Appln. KOKAI Publication No. 2000-206813 discloses a technique wherein when a heating roller (or a heating belt) is heated with use of a plurality of coils, the ratio of the amounts of power applied to the coils is varied so as to make uniform the heating temperature distribution in the longitudinal direction of the heating roller. It also discloses a technique wherein a difference between temperatures of temperature detection means is detected, and the ratio of the amounts of power applied to the respective coils is varied, thereby driving the coils at the same time. Further, it discloses a technique wherein when the temperature of a paper non-feed region does not decrease, as in a case of feeding a small-sized paper sheet, the ratio of power to a coil that heats a side-end portion of the heating roller is decreased while the ratio of power to a coil that heats a central portion of the heating roller is increased.

Jpn. Pat. Appln. KOKAI Publication No. 2001-312178 discloses a technique wherein there is provided a circuit for independently controlling power to each of a plurality of coils, as in the above-described technique, and the frequency of the circuit is varied to alter the ratio of supply powers to the respective coils, thus making uniform the temperature of the heating roller.

Although there is no particular document, the wire for the coil used in an induction heating device is generally affected by a skin effect due to high frequencies. Thus, litz wire (twisted wire), which is composed of a plurality of twisted fine strands, is used for the wire of the coil. This structure is publicly known.

The outside diameter of the litz wire, which has a substantially circular cross section, is determined by the following formula:

$$\text{outside diameter } D = 1.155 \times d \times \sqrt{N} \text{(mm)}$$

where d: the outside diameter of an elementary strand (mm), and

N: the number of strands.

Based on this value, a maximum possible number of turns in cross section of the coil is considered in the prior art.

However, according to the drive method of the coil disclosed in Jpn. Pat. Appln. KOKAI Publication No. 2-270293, there is merely a description that the transistor device is switched at 0 V of the AC power supply. In addition, neither a switching time nor a switching timing is described. Thus, there is no method or solution in order to execute a fine temperature control.

Furthermore, if the litz wire is formed with the aforementioned diameter, there is a limit to the density of coil winding in cross section.

BRIEF SUMMARY OF THE INVENTION

The object of the present invention is to provide a heating device that executes a fine temperature control, and an induction-heating type fixing device using the heating device and having an improved density of coil winding.

In order to achieve the object, the present invention may provide a heating device including an AC power supply; a rectifying circuit that converts an AC current from the AC power supply to a DC current; a plurality of inverter circuits each comprising a resonance circuit composed of an electromagnetic induction coil and a resonance capacitor connected to an output side of the rectifying circuit and a switching element that excites the resonance circuit; and a plurality of drive circuits each supplying a drive signal to the associated switching element of the associated inverter circuit, the heating device comprising: a first control section that effects a control to select one of the plurality of drive circuits and to enable the selected drive circuit to supply the drive signal; and a second control section that effects a control to set a minimum time interval for switching at 1/(half-wave length of a frequency of the AC power supply) or more, the minimum time interval being defined between a time point at which the drive signal is supplied from the drive circuit selected by the first control section and a time at which the other drive circuit is selected and the supply of the drive signal is switched to supply the drive signal from the other drive circuit.

The invention may also provide a fixing device that supplies a high-frequency current to an electromagnetic induction coil disposed near an endless member having a conductive metal layer, heats the endless member, and heats an image-fixation medium, wherein a wire, of which the electromagnetic induction coil is formed, is a litz wire composed of a plurality of twisted strands, and the litz wire has a plurality of cross-sectional shapes.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will now be described with reference to the accompanying drawings.

To begin with, a first embodiment of the invention is described.

Figure 1:
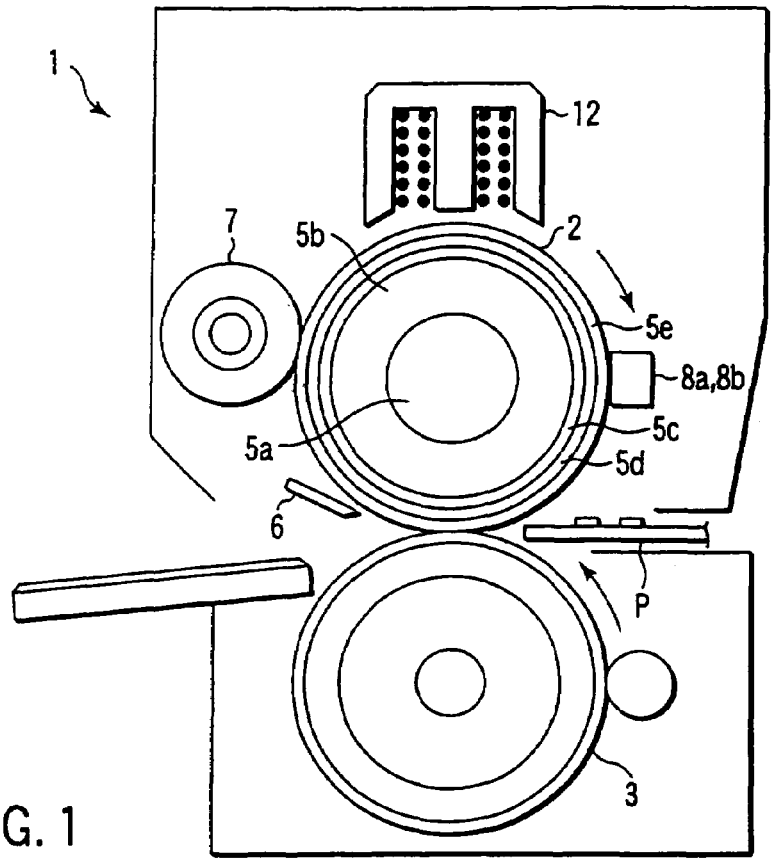
FIG. 1 is a cross-sectional view schematically showing the whole structure of a fixing device according to the present invention.

FIG. 1 shows the whole structure of a fixing device 1 used in an image forming apparatus.

Figure 2:
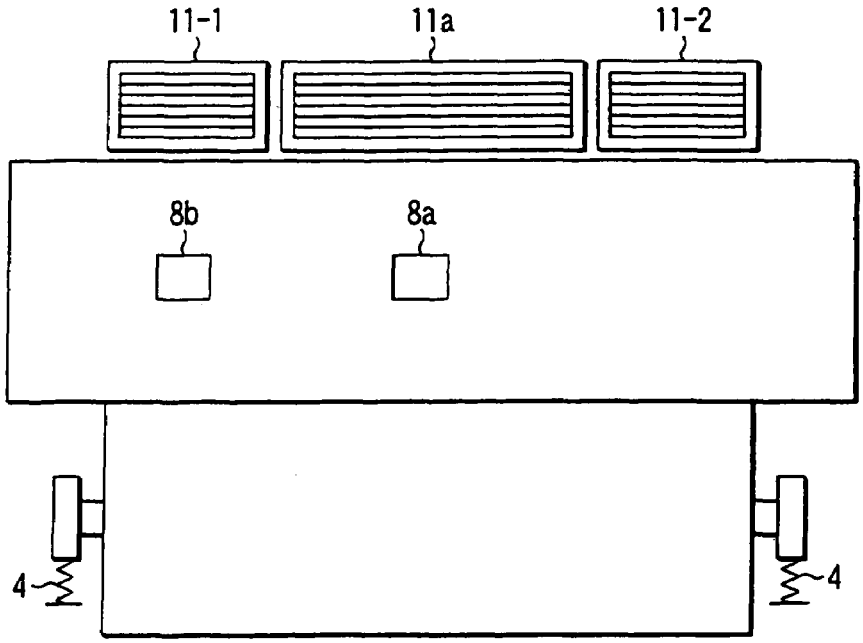
FIG. 2 is a diagram showing the fixing device in its longitudinal direction.

FIG. 2 is a diagram showing the fixing device 1 in its longitudinal direction.

The fixing device 1 includes a heating roller 2 (ϕ40 mm) and a press roller 3 (ϕ40 mm). The heating roller 2 is driven by a drive motor (not shown) in a direction of the arrow, and the press roller 3 rotates following the rotation of the heating roller 2 in a direction of the arrow. The press roller 3 is put in pressure contact with the heating roller 2 by a pressing mechanism 4 so that a predetermined nip width is provided between the rollers 3 and 2.

The heating roller 2 comprises a metal core 5*a*, foamed rubber (sponge) 5*b*, a metal conductive layer 5*c*, a solid rubber layer 5*d*, and a release layer 5*e* in the named order from the inside.

In the present embodiment, the thickness of the foamed rubber is 5 mm and nickel is used as the material of the metal conductive layer.

In this embodiment, nickel is used as the metal conductive layer. Alternatively, stainless steel, aluminum, a composite of stainless steel and aluminum, etc. may be used.

The press roller 3 is constructed such that silicone rubber, fluoro-rubber, etc. is coated on the metal core. When paper P passes through a fixing point, which lies at a pressure-contact portion (nip portion) between the heating roller 2 and press roller 3, a developer on the paper is fused and fixed.

Around the heating roller 2, a releasing blade 6 for stripping the paper P from the heating roller 2 and a release agent applying device 7 for applying an offset preventing release agent to the heating roller 2 are disposed on the downstream side of the contact position (nip portion) between the heating roller 2 and press roller 3 in the rotational direction.

A plurality of thermistors (8*a*, 8*b*) are arranged as temperature detection means in the longitudinal direction of the heating roller 2. In this embodiment, two thermistors are provided, but the number of thermistors may be three or more.

Using a central thermistor 8*a* and a side-end thermistor 8*b*, the temperature of the heating roller 2 is detected and a temperature distribution of the heating roller 2 is adjusted.

A heating device in the fixing device 1 is described below.

The heating device comprises induction heating means disposed at a peripheral surface of the heating roller 2. In this embodiment, a plurality of excitation coils (11*a*, 11-1, 11-2) are used to heat the heating roller 2.

In this embodiment, an excitation coil unit (electromagnetic induction coil unit) comprises three divisional coils. Except the central coil 11*a*, the other coils are driven by the same control. The side-end coils 11-1 and 11-2 are connected in series. In the description below, the side-end coil 11-1, 11-2 is referred to as a side-end coil 11*b*.

The coil 11*a*, 11*b* uses a magnetic core 12 so as to exhibit characteristics even if the number of turns of winding is decreased.

A magnetic flux can be concentrated by the shape of coil, and the heating roller 2 is heated in a locally concentrated manner.

In this embodiment, the coils 11*a* and 11*b* are selectively driven to heat the heating roller 2.

The excitation coil 11*a*, 11*b* is formed using a copper wire element with a diameter of 0.5 mm. Specifically, the coil is formed of litz wire that is composed of a plurality of strands twisted together and individually insulated. The use of the litz wire can reduce the wire diameter to be less than a permeation depth, and allows an AC current to flow effectively. In this embodiment, 16 strands each having a diameter of ϕ0.5 mm are twisted together. A heat-resistant polyamide-imide is used as a coating material for the coil.

The excitation coil 11*a*, 11*b* is driven by a radio-frequency current supplied from an excitation circuit (inverter circuit) (not shown) to produce a magnetic flux. Thereby, the excitation coil 11*a*, 11*b* causes a magnetic flux and eddy current in the heating roller 2 so as to prevent a variation in magnetic field. The eddy current and the inherent resistance of the heating roller 2 produce Joule heat, and the heating roller 2 is heated. In this embodiment, a radio-frequency current with 20 to 50 kHz is caused to flow in the excitation coil 11*a*, 11*b*. In addition, by varying the drive frequency of the inverter circuit, the output can be altered in a range of 700 W to 1500 W.

The excitation coils 11*a* and 11*b* heat the central part and side-end part of the heating roller 2, respectively. That is, when the central coil 11*a* is driven, eddy current is produced in the central part of the heating roller 2 and the central part is heated up to a higher temperature by the produced Joule heat. On the other hand, when the side-end coil 11*b* is driven, eddy current is caused in the side-end part of the heating roller 2 and the side-end part is heated up to a higher temperature by the produced Joule heat.

On the basis of temperatures detected by the central thermistor 8*a* and side-end thermistor 8*b*, the central coil 11*a* and side-end coil 11*b* are selectively driven, and the temperature of the heating roller 2 is elevated and the fixation control temperature is maintained.

Normally, the heating roller 2 is rotated during heating.

Figure 3:
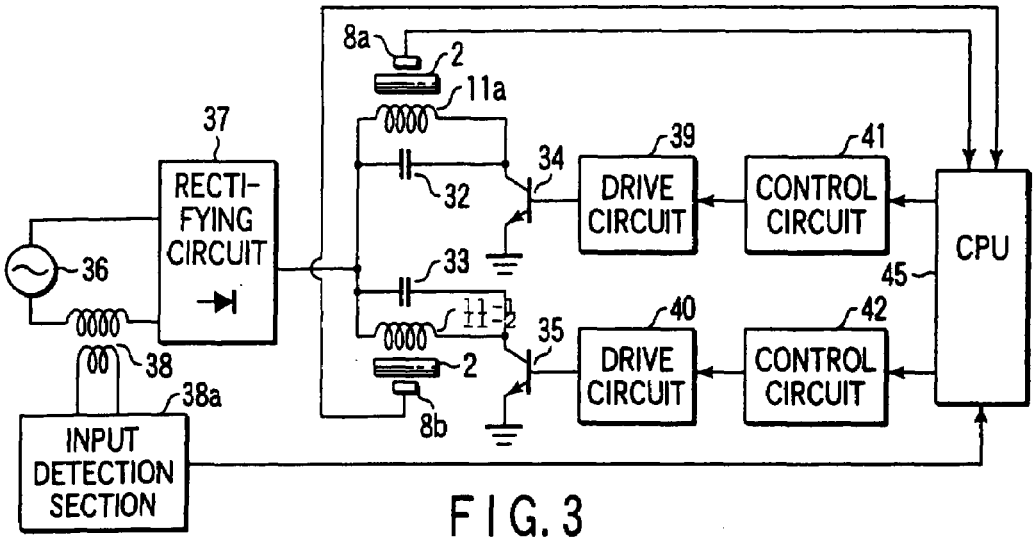
FIG. 3 is a block diagram showing an electrical construction relating to temperature detection and a method of controlling excitation coils and oscillation circuits (inverter circuits)

FIG. 3 schematically shows an electrical construction relating to temperature detection and a method of controlling excitation coils and oscillation circuits (inverter circuits).

Capacitors 32 and 33 for resonance are connected in parallel with the excitation coils 11*a* and 11*b* shown in FIG. 1, respectively. The resonance circuits thus constructed are connected to switching elements 34 and 35, thereby forming inverter circuits. An IGBT or a MOS-FET, which is used with a high breakdown voltage and a large current, is applied to the switching element 34, 35. In this embodiment, the IGBT is used.

A DC current, which is obtained by smoothing power from a commercial AC power supply through a rectifying circuit 37, is supplied to the inverter circuits. A transformer 38 is provided at a front stage of the rectifying circuit 37, and a total consumption power can be detected by an input detection section 38*a*. Based on the power detection, power is fed back.

Drive circuits 39 and 40 are connected to control terminals of the switching elements 34 and 35. The drive circuit (39, 40) applies a drive voltage to the control terminal of the switching element (34, 35), thus turning on the switching element. Control circuits 41 and 42 produce timing signals for the application of the drive voltage. That is, each control circuit 41, 42 controls a turn-on time and alters the frequency in a range of 20 to 50 kHz, thus varying the output value.

A to-be-heated member (heating roller 2 in this embodiment), which is heated by the coils, is provided with the temperature-sensing thermistors 8*a* and 8*b*, as mentioned above. Temperature detection signals (voltage values) from the thermistors are input to a CPU 45. In accordance with the values produced by the thermistors (8*a*, 8*b*), the CPU 45 sends to the control circuits 41 and 42 instructions as to which coil (11*a* or 11*b*) is to be driven, as to whether all the coils (11*a* and 11*b*) are to be turned off, and as to what output values are to be set.

Figure 4:
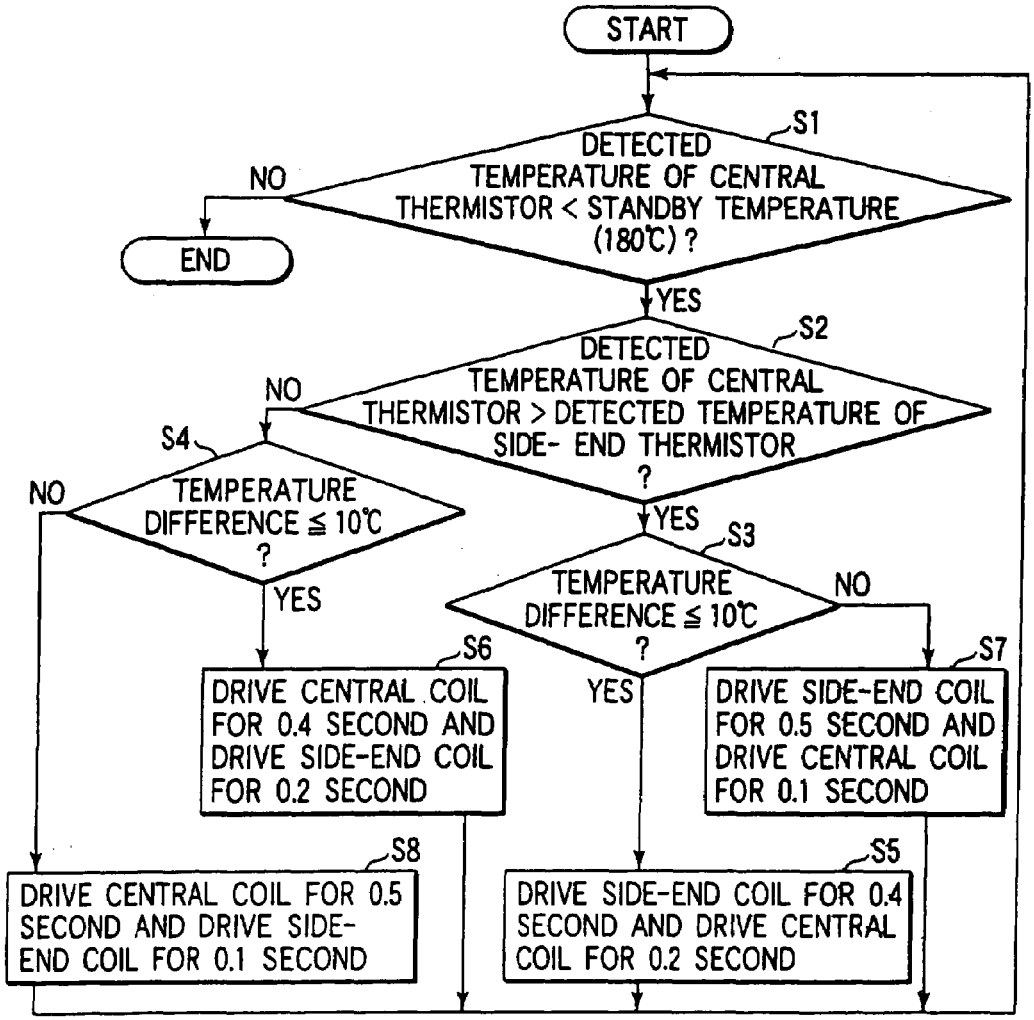
FIG. 4 is a flow chart illustrating a control operation for heating a heating roller.

With the above structure, the control operation for heating the heating roller 2 will now be described with reference to a flow chart of FIG. 4.

To begin with, an operation at a warming-up time is described.

The CPU 45 first detects the temperature of the central thermistor 8*a* and determines whether the detected temperature of the central thermistor 8*a* reaches a control temperature (180° C. in this embodiment) (S1). At this time, if the detected temperature exceeds 180° C., the CPU 45 outputs stop instructions to both control circuits 41 and 42.

In step S1, if the detected temperature does not exceed 180° C., the CPU 45 compares the measured temperature of the central thermistor 8*a* and that of the side-end thermistor 8*b* (S2).

If the temperature of the central thermistor 8*a* is higher than that of the side-end thermistor 8*b*, the CPU 45 selects the control circuit 42 corresponding to the side-end thermistor 8*b*. In this case, the time period for the selection of the control circuit 42 is 0.4 second in this embodiment. Then, the CPU 45 halts the selection of the control circuit 42 and, in turn, selects the control circuit 41. In this case, the time period for the selection of the control circuit 41 is 0.2 second in this embodiment.

The controls in steps S3 and S4 will be described later.

As a result, the side-end coil 11*b* associated with the control circuit 42 is driven for 0.4 second (S5), and the associated region (side-end part) of the heating roller 2 is heated. Then, the central coil 11*a* associated with the control circuit 41 is driven for 0.2 second (S5) and the associated region (central part) of the heating roller 2 is heated.

Thereafter, the CPU 45 returns to the control in step S1.

In step S2, if the temperature detected by the central thermistor 8*a* is lower than the temperature detected by the side-end thermistor 8*b*, the CPU 45 selects the control circuit 41 for 0.4 second and selects the control circuit 42 for 0.2 second, contrary to the above-described case.

As a result, the central coil 11*a* associated with the control circuit 41 is driven for 0.4 second (S6), and the associated region (central part) of the heating roller 2 is heated. Then, the side-part coil 11*b* associated with the control circuit 42 is driven for 0.2 second (S6) and the associated region (side-end part) of the heating roller 2 is heated.

Then, the CPU 45 returns to the control in step S1.

With the above-described control, the heating time for the low-temperature side is set to be longer so that the difference in temperature between the central thermistor 8*a* and side-end thermistor 8*b* may gradually decrease. When the temperature of the heating roller 2 has reached 180° C. (S1) by repeating this control, the warming-up operation is completed.

The same control is executed in the ready state, but the operation frequency instructed to the drive circuits 39 and 40 by the control circuits 41 and 42 is varied. Specifically, at the warming-up state, the drive circuits 39 and 40 operate at the frequency for effecting 1300 W heating. At the ready state, the drive circuits 39 and 40 operate at the frequency for effecting 700 W heating.

In the case where the difference in temperature does not decrease with the coil drive time periods of 0.4 second and 0.2 second, if the difference in temperature becomes more than a predetermined value, the coil drive time periods for heating are set at 0.5 second and 0.1 second, thereby to decreasing the difference. For example, if the temperature difference in step S3 exceeds 10° C., the side-end coil 11*b* is driven for 0.5 second and the central coil 11*a* is driven for 0.1 second (S7). If the temperature difference in step S4 exceeds 10° C., the central coil 11*a* is driven for 0.5 second and the side-end coil 11*b* is driven for 0.1 second (S8).

In the present embodiment, the CPU 45 switches the driving of the central coil 11*a* and side-end coil 11*b* at a timing at which the voltage of the commercial AC power supply becomes 0 V. The switching at 0 V prevents the excitation coils from suffering an abrupt voltage or current, whereby a phenomenon such as vibration of heating roller 2 can be avoided. The switching at 0 V is enabled by setting the excitation coil drive time at an integer number of times of 1/(half-wave length of AC power supply frequency).

In the present embodiment, the excitation coil drive time is set at 0.4 second, 0.2 second, 0.5 second, etc. A minimum possible drive time may be 1/(half-wave length of AC power supply frequency).

In the present embodiment, if the frequency of commercial AC power supply is 50 Hz, the switching can be effected at 1/(50×2)=0.01 second. Since the power can be detected at half-wave length and fed back, the switching can be effected at the aforementioned time.

Figure 5:
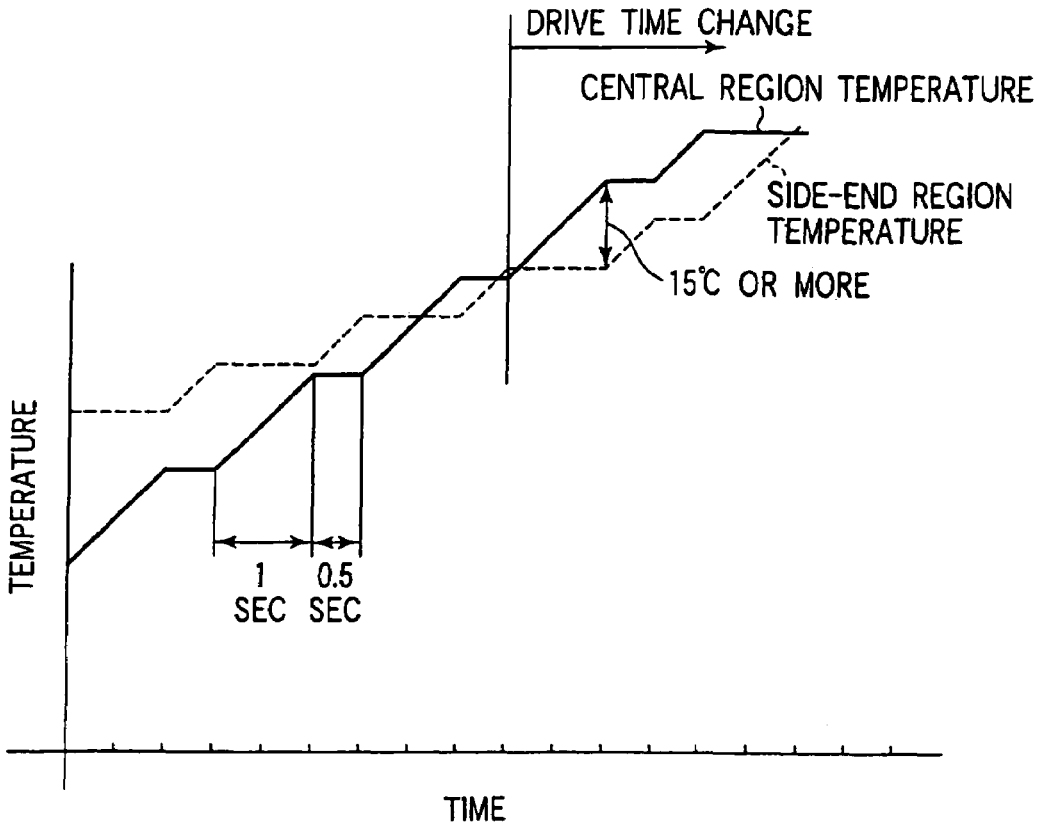
FIG. 5 is a graph showing a roller temperature variation at the time of switching the coil.

Besides, the present embodiment includes the control for setting the drive time of one of the excitation coil at 0.5 second or less. The reason is explained. Recently, as in the present embodiment, the thermal capacity of the heating roller tends to decrease to realize a shorter warming-up time. In the case of the roller wherein the metal layer is coated on the outer surface of the elastic layer (foamed rubber) as in the present embodiment, the thin metal layer is heated from the outside by the induction-heating coils. Thus, the temperature rises instantaneously. Consequently, if one of the excitation coils is continuously driven for 0.5 second or more, a temperature difference (temperature ripple) between a region A and a region B, as shown in FIG. 5, would become 15° C. or more. In addition, as the supplied output is increased, the difference becomes conspicuous.

Figure 6:
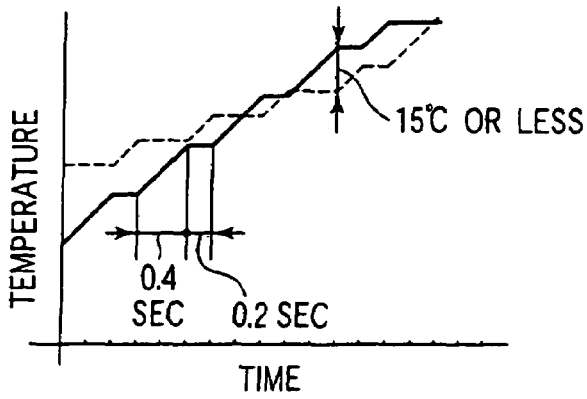
FIG. 6 is a graph for explaining a control method for the excitation coils and oscillation circuits.

Experiments conducted in the present embodiment demonstrate that the temperature difference, as shown in FIG. 6, in the longitudinal direction of the heating roller needs to be 15° C. or less in order to clearly fix a color image. In order to decrease the temperature difference within the range of 15° C., switching within 0.5 second is necessary. If switching is effected within a shorter time period, a finer control can be executed.

In the case of the commercial AC frequency of 50 Hz, however, power feed-back is difficult if switching is effected at a time shorter than 0.01 second. Thus, the minimum switching time is set at 0.01 second or more.

Basically, it is at the time of feeding paper that the temperature ripple needs to be reduced to 15° C. or less. Accordingly, at the time of feeding paper, the switching time is set at 0.5 second or less.

In an ordinary control method, the excitation coil associated with the lower detection temperature side is continuously driven, and if the relationship in temperature is reversed, the opposite excitation coil is driven. This method depends on the detection time of the temperature detection means. At present, the reaction time of the sensor used as temperature detection means is about 0.5 second, and so it is difficult to keep the temperature ripple at 15° C. or less by a method that does not control the drive time. Thus, the continuous drive time of one of the excitation coils is set at 0.5 second or less, at least during the feeding of paper.

This control method is similarly effective in the case of fixing images on small-sized paper sheets. To be more specific, a region where small-sized paper is passed is heated for 0.4 second, since a temperature decrease at the surface of the heating roller is large in this region. On the other hand, a region where paper is not passed is heated for 0.2 second since the part of the heating roller in this region does not easily lose heat. If the temperature difference in this state further increases, the switching time is changed to 0.5 second and 0.1 second. Thereby, the temperature of the heating roller in the longitudinal direction can be made uniform, and the temperature ripple can be kept at 15° C. or less, thus achieving good fixing properties.

In this embodiment, first driving of one of the excitation coils, which are both in the turn-off state, is effected by "soft-start" in which a power is gradually increased to a target value. When the driving of the coil is started in the state in which both excitation coils are turned off, power is abruptly supplied from a "zero" state. If a target power value is to be attained by instantaneous control, rush current may flow. The rush current may cause a problem of flickering, etc., but in this embodiment at least the first driving of each excitation coil is effected by the soft-start.

When the first driven excitation coil is switched to the next excitation coil, soft-start is not performed. The reason is that if soft-start is effected each time the switching is made, a power fluctuation occurs and a problem of flickering arises, contrary to the above case.

In this embodiment, as mentioned above, the switching may be made at half-wave length of the commercial AC power supply. Thus, when one excitation coil is switched to the other excitation coil, the detected output feedback value is retained until the excitation coil is driven at the next time. When the excitation coil is driven at the next time, the retained feedback value is used to control the output.

In the present embodiment, a predetermined drive time of the excitation coil is set for heating. However, if the reaction speed of the temperature detection means is high and the drive-switching within 0.5 second is possible in the control for heating the lower-temperature side, this method may be adopted. In other words, if the temperature difference of the temperature detection means is detected within 0.5 second and an instruction to drive the lower-temperature side excitation coil is delivered, the heating time may be voluntarily set without specifying the drive time periods for the central coil and side-end coil.

However, if either of the temperature detection means malfunctions, it is possible that only one of the coils is continuously driven for heating. If one of the coils is continuously driven for heating, not only a problem with image quality, but also other problems arise, for instance, abnormal heat production due to a temperature rise, or damage to the heating roller due to a difference in thermal expansion of the roller caused by the temperature rise.

In order to keep the temperature ripple within 15° C. or less for good image quality, the switching of the coils is normally effected within a range of 0 to 5 seconds. However, in this embodiment, in order to detect abnormality in temperature or possibility of a roller damage due to thermal expansion, there is provided a safety mechanism which stops the fixing device in response to an error detection when one of the coils is continuously driven for 10 seconds or more for heating. This mechanism is controlled as a safety device.

A second embodiment of the invention will now be described.

A fixing device according to the second embodiment has the same structure as the fixing device 1 of the first embodiment shown in FIG. 1. The difference is that the wire used for the excitation coils is not the litz wire but a single wire. The number of turns of winding is unchanged. The diameter of the wire is $\phi 1$ mm.

Figure 7:
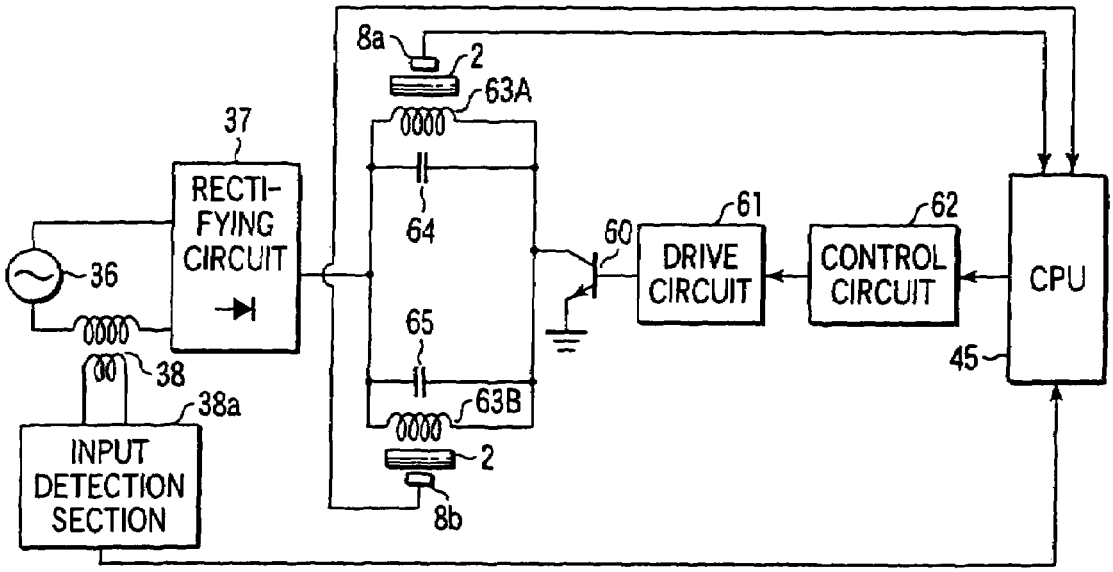
FIG. 7 is a block diagram showing an electrical construction relating to temperature detection and a method of controlling excitation coils and an oscillation circuit (inverter circuit)

FIG. 7 is a block diagram showing an electrical construction relating to temperature detection and a method of controlling excitation coils and an oscillation circuit (inverter circuit).

The difference from the first embodiment is that there are provided a single switching element 60, a single drive circuit 61 and a single control circuit 62. Excitation coils 63A and 63B corresponding to the central coil 11*a* and side-end coil 11*b* are connected in parallel. Resonance circuits are constructed by the excitation coil 63A and a capacitor 64 and by the excitation coil 63B and a capacitor 65, respectively.

In this embodiment, the operational frequency of the drive circuit 61 (i.e. the on/off duty ratio of the switching element) is 1 MHz to 5 MHz. Compared to the first embodiment, the drive circuit 61 operates a higher frequency. Accordingly, the frequency of current flowing through the excitation coil 63A, 63B is high and a surface depth is shallow. Thus, a more current flows at the surface of the metal layer and the heat production efficiency is enhanced.

The heating of the heating roller 2 is controlled by comparing measured temperatures of the temperature detection means (thermistors 8*a* and 8*b*) and selecting one of the excitation coils 63A and 63B. This method is the same as in the first embodiment, and a description thereof is omitted.

The differences between the first embodiment and second embodiment are described.

In the first embodiment, the CPU selects the control circuit and drive circuit for the excitation coil associated with the region that requires heating, thereby heating the heating roller.

On the other hand, the second embodiment includes only a single set of control circuit 62, drive circuit 61 and switching element 60. In this embodiment, which excitation coil (63A or 63B) is selectively heated is determined by the alteration of the frequency instructed from the control circuit 62 to the drive circuit 61.

The excitation coils 63A and 63B have respective resonance frequencies. The resonance frequencies of excitation coils 63A and 63B are designed to differ from each other. In this embodiment, the resonance frequency of the excitation coil 63A is approximately set at 2 MHz, and that of the excitation coil 63B is approximately set at 3 MHz. Thus, in order to drive the excitation coil 63A to heat the associated region of the heating roller 2, the excitation coil 63A may be driven at 2 MHz. On the other hand, in order to drive the excitation coil 63B to heat the associated region of the heating roller 2, the excitation coil 63B may be driven at 3 MHz.

With this control, one of the excitation coils (63A, 63B) can be selectively driven, and the heating roller 2 can be heated uniformly in its longitudinal direction.

In this embodiment, the time period for continuously driving one of the excitation coils (63A, 63B), that is, the time period for driving one of the excitation coils with the resonance frequency at which the coil resonates, is set at 0.4 second, 0.2 second, 0.5 second, etc. In this case, the minimum drive time may be set at 1/(half-wave length of AC power supply frequency).

In the present embodiment, if the frequency of commercial AC power supply is 50 Hz, the switching can be effected at 1/(50×2)=0.01 second. Since the power can be detected at half-wave length and fed back, the switching can be effected at the aforementioned time.

Besides, the present embodiment includes a control for setting the drive time of one of the excitation coil (i.e. a time for making the resonance frequency constant) at 1 second or less.

The reason for setting the drive at 1 second or less is explained below.

In the present embodiment, as described referring to FIG. 7, the drive frequency is varied and one of the excitation coils, which has the corresponding resonance frequency, is driven. Thus, unlike the first embodiment, there is no such a state that one of the excitation coils is completely turned on and the other is completely turned off. That is, power is supplied, although inefficiently, to the coil whose resonance frequency is not matching with the drive frequency, and the associated region of the heating roller is partially heated. If the total ratio of heating is 10, the heating ratio between the two regions is not 10:0 but about 8:2.

Thus, compared to the case of the first embodiment wherein the associated region of the driven coil is heated at a ratio of 10:0, the temperature rise gradient is gentle. If the switching time of resonance frequency is set at 1 second or less, the temperature ripple decreases to 15° C. or less and no adverse effect is caused to the image fixing properties. Therefore, in the case of this driving method, no problem arises if the switching is effected within 1 second or less.

The difference between the first embodiment and second embodiment resides in the driving method. A difference occurring due to the difference in the driving method is the aforementioned limitations to the heating time. Since the gradient in temperature rise is gentle, this is advantageous in terms of temperature ripple. In the other respects, the same advantages can be obtained.

In both the first and second embodiments, the heating roller comprises a metal core, foamed rubber (sponge), a metal conductive layer, a solid rubber layer and a release layer in the named order from the inside. However, the use of an iron roller or a metal belt can achieve the same advantages.

Even if the heating roller is used for the press roller side, the same advantages can be obtained. Further, the excitation coil may be incorporated within the heating roller.

Besides, in the present embodiment, two excitation coils are used. Alternatively, more than two excitation coils may used with the same advantages obtained.

A third embodiment of the invention will now be described.

Figure 8:
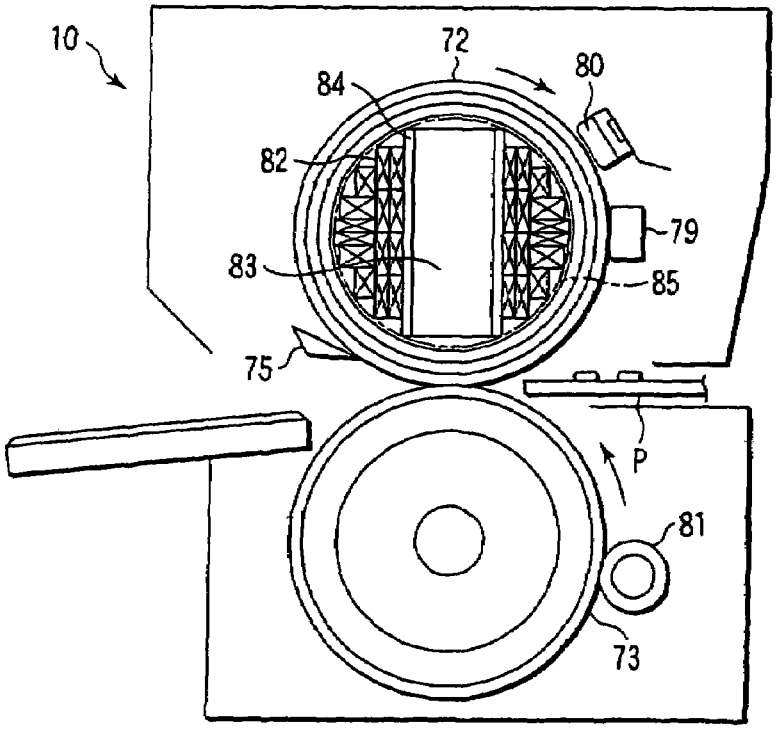
FIG. 8 is a schematic cross-sectional view showing the whole structure of a fixing device.

FIG. 8 is a schematic cross-sectional view showing the whole structure of a fixing device 10 according to the third embodiment.

The fixing device 10 includes a heating (fixing) roller 72 (ϕ40 mm) and a press roller 73 (ϕ40 mm). The heating roller 72 is driven by a drive motor (not shown) in a direction of the arrow, and the press roller 73 rotates following the rotation of the heating roller 72 in a direction of the arrow. The press roller 73 is put in pressure contact with the heating roller 72 by a pressing mechanism so that a predetermined nip width is provided between the rollers 73 and 72.

The heating roller 72 is formed of iron, with a wall thickness of 1 mm. A release layer of, e.g. Teflon, is coated on the surface of the heating roller 72. In this embodiment, iron is used as the material of the roller. Alternatively, stainless steel, aluminum or a composite of stainless steel and aluminum may be used.

The press roller 73 is constructed such that silicone rubber, fluoro-rubber, etc. is coated on the metal core. When paper P passes through a fixing point, which lies at a pressure-contact portion (nip portion) between the heating roller 72 and press roller 73, a developer on the paper is fused and fixed.

Around the heating roller 72, a separation gripper 75 for stripping the paper P from the heating roller 72, a thermistor 79 for detecting the temperature of the heating roller 72 and a thermostat 80 for detecting abnormality in surface temperature of the heating roller 72 and stopping heating are disposed on the downstream side of the contact position (nip portion) between the heating roller 72 and press roller 73 in the rotational direction.

A cleaning roller 81 for cleaning toner is provided on an outer periphery of the press roller 73.

In the principle of heating, an induction heating device (magnetic field generating means) is employed.

The structure of the excitation coil in the induction heating device is described in detail.

An excitation coil 82 is disposed within the heating roller 72. The excitation coil 82 is formed using a copper wire element with a diameter of 0.5 mm. Specifically, the coil is formed of litz wire that is composed of a plurality of strands twisted together and individually insulated. The use of the litz wire can reduce the wire diameter to be less than a permeation depth, and allows an AC current to flow effectively. In this embodiment, 19 strands each having a diameter of ϕ0.5 mm are twisted together. A heat-resistant polyamide-imide is used as a coating material for the coil.

A core member 83 for increasing the magnetic flux of the coil is used for the excitation coil 82. By using the core member 83, the magnetic flux can be increased with a small number of turns of winding. In this embodiment, ferrite is used as the core member. Alternatively, a silicon steel plate, amorphous material, etc. may be used. A heat-resistant insulating resin 84 for insulating the coil and the core is provided on the outside of the core member 83. In this embodiment, phenol resin is used as the heat-resistant resin material.

A coating tube 85 for maintaining insulation between the coil and roller is provided on the surface of the excitation coil 82. The coating tube 85 is formed of a heat-resistant resin. In this embodiment, PET is used, but fluoro-resin, PI, PPS, silicone rubber, etc. may be used. In addition, in this embodiment, the thickness of the coating tube is set at 0.3 mm so as to prevent damage or removal of coating due to contact between the roller and coil at the time of replacing the coil.

The cross-sectional shape of the wire is described.

The cross section of litz wire is normally circular. In general, the outside diameter of the litz wire is approximately calculated by the following formula:

$$\text{outside diameter } D=1.155\times d\times\sqrt{N}(\text{mm})$$

where d: the outside diameter of an elementary strand (mm)

N: the number of strands.

In the prior art, based on this value, a maximum possible number of turns in coil cross section has been considered.

Figure 9:
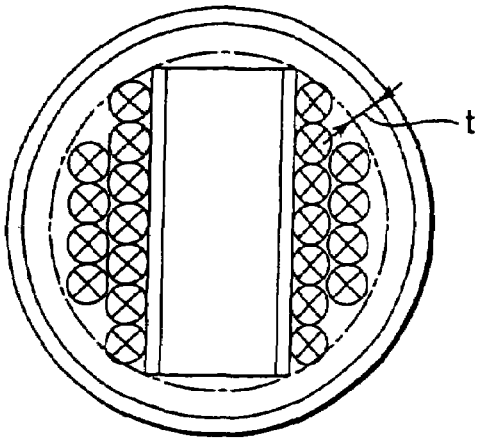
PRIOR ART FIG. 9
FIG. 9 is a cross-sectional view showing a coil in which litz wire is wound in a conventional fashion.

FIG. 9 shows a coil cross section in a case where litz wire is wound in a conventional fashion. The litz wire has a circular cross section in normal cases, but it may have an irregular shape. Thus, the litz wire is wound, as shown in FIG. 9. The coil is provided with a predetermined clearance t for preventing contact with the inside of the roller. In order to keep a predetermined clearance, 11 turns were optimal, as shown in FIG. 9. In order to increase the number of turns, there is a method of decreasing the thickness of the core. However, if the core is made thinner, a magnetic saturation may occur. Therefore, the core cannot be made thinner without due consideration. In this situation, in the prior art, in order to increase the number of turns, it was necessary to decrease the clearance t from the roller, or to increase the size of the roller.

Figure 10:
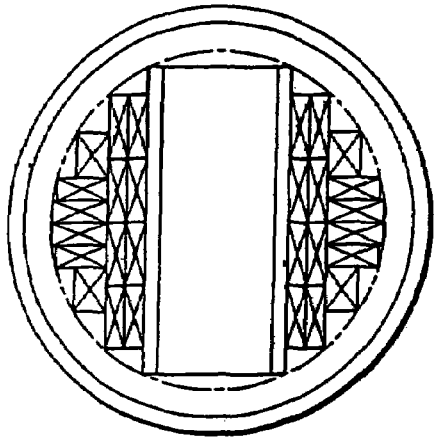
FIG. 10 shows a coil arrangement (enlarged) according to the embodiment.

FIG. 10 shows an arrangement of the coil (in enlarged scale) in the third embodiment. In this embodiment, a litz wire with a normally circular cross section is pressed to have a rectangular cross section, and an aspect ratio thereof is adjusted. Accordingly, the wire can be efficiently arranged with a predetermined distance from the roller. Thereby, the density of coil winding is increased and a greater number of turns of winding is achieved. Compared to the conventional wire with a fixed circular cross section, the density of coil winding is increased and so the diameter of the roller can be reduced.

Furthermore, the cross section of the wire is suitably altered depending on the position where the wire is located. Therefore, the space can effectively be used.

The 11 turns in the prior art can be increased to 14 turns in this embodiment. Thereby, the inductance is increased and the characteristics of the coil can be enhanced.

In the present embodiment, the coil is disposed within the heating roller. Needless to say, the same advantage can be obtained even if the coil is disposed outside the heating roller. That is, even if the coil is disposed outside the heating roller, the density of coil winding can be increased. Thereby, the coil can be disposed in a small region, and reduction in size can be achieved.

A fourth embodiment of the present invention will now be described.

Figure 11:
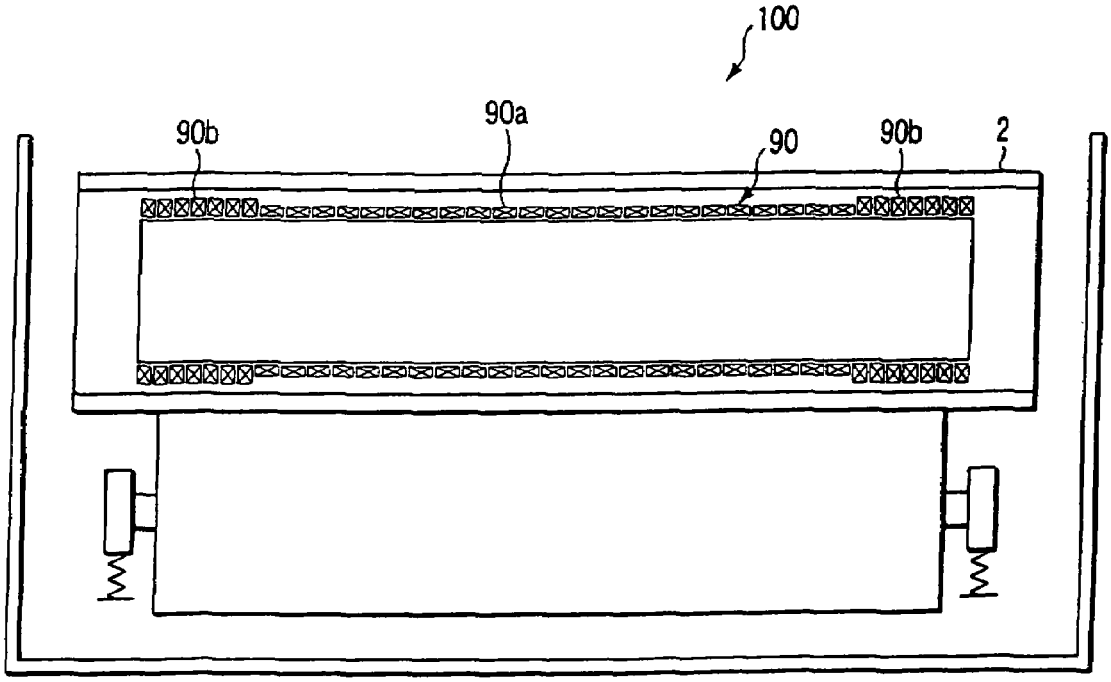
FIG. 11 is a longitudinal cross-sectional view of the fixing device with respect to the coil arrangement.

FIG. 11 is a longitudinal cross-sectional view of a fixing device 100 with respect to the coil arrangement according to the fourth embodiment.

In this embodiment, a coil 90 is wound in a solenoid fashion in the longitudinal direction of the heating roller 2. The wire, like the preceding embodiments, is litz wire composed of 19 strands each having a diameter of ϕ0.5 mm. Furthermore, the cross section of the wire is altered depending on the position where the wire is located. Specifically, the cross section of the litz wire is varied between a central region and a side-end region in the longitudinal direction of the roller. The coil cross section is designed such that the density of winding is higher in the side-end region than in the central region in the longitudinal direction of the heating roller. The vertical/horizontal ratio in cross section of a central coil portion 90*a* is about 1:2, and the vertical/horizontal ratio in cross section of a side-end coil portion 90*b* is about 3:2.

As described above, the number of turns per unit length of the side-end coil portion 90*b* is greater in the longitudinal direction of the heating roller 2. The reason is that the degree of heat conduction to the bearing, etc. is large in the side-end region of the heating roller 2, and the temperature in the side-end region tends to become lower than that in the central region. In the prior art, in order to remedy this condition, the pitch of winding in the central region is decreased while the pitch of winding in the side-end region is increased.

In this case, however, if the pitch of winding is decreased, gaps are created among the turns of winding and a variance in temperature occurs between the location where the coil is present and the location where the coil is absent. Besides, if the coil is wound with predetermined intervals among the turns, the precision in position becomes important. To solve this problem, there is a conventional method wherein a coil bobbin is provided with a guide along which the coil is to be wound. In this method, however, the positioning is difficult and the number of working steps for winding increases.

By contrast, in the present embodiment, the cross-sectional shape of the litz wire is altered. Even if the coil is wound in a normal fashion, the altered cross section can naturally bring about the same advantage as in the case where the pitch of coil winding is altered. Thereby, the density of coil winding in the side-end region of the roller is increased, and a decrease in temperature in this region can be prevented.

The circuit configuration and temperature control method of the present embodiment and preceding embodiment are the same as those of the first embodiment, so a description thereof is omitted.

As has been described above, according to the embodiments of the present invention, the temperature distribution of the heating roller in the longitudinal direction can be made uniform, and the temperature ripple can be reduced.

In addition, the arrangement of the coil wire for the heating roller can be optimized.

Furthermore, the density of winding of the coil for the heating roller can be enhanced.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method for heating a detection object, for use in a fixing apparatus, comprising:

determining that a detected temperature of a center of a detection object is higher than a predetermined temperature;

determining whether or not the detected temperature of the center of the detection object is higher than a detected temperature of each of both side portions of the detection object, which are located on both sides of the detection object with respect to the center of the detection object; and controlling power supplied to a coil provided for the center of the detection object to cause the power to be larger in amount than power supplied to each of coils provided for the side portions of the detection object, when it is determined that the detected temperature of the center of the detection object is not higher than the detected temperature of said each of both side portions of the detection object, and controlling the power supplied to said each of the coils provided for the side portions of the detection object to cause the power to be larger in amount than the power supplied to the coil provided for the center of the detection object, when it is determined that the detected temperature of the center of the detection object is higher than the detected temperature of said each of the side portions of the detection objects, the controlling of the power supplied to the coil provided for the center of the detection object and the controlling of the power supplied to the coils provided for the side portions being carried out asynchronously, wherein the powers supplied to the coil for the center of the detection object and said each of the coils for the end portions of the detection object are controlled in amount by changing time for which the power is supplied to the coil for the center of the detection object and time for which the power is supplied to said each of the coils for the end portions thereof.

2. The method according to claim 1, wherein the time for which the power is supplied to the coil for the center of the detection object and the time for which the power is supplied to said each of the coils for the end portions of the detection object are set such that in each of time periods, time for which the power is supplied to one of the coil for the center of the detection object and said each of the coils for the end portions of the detection object is longer than time for which the power is supplied to the other.

3. The method according to claim 1, wherein when a higher one of the detected temperature of the center of the detection object and the detected temperature of said each of the end portions of the detection object becomes lower than the other, a longer one of the time for which the power is supplied to the coil for the center of the detection object and the time for the power is supplied to said each of the coils for the end portions of the detection object is set to be shorter than the other.

4. The method according to claim 2, wherein when a higher one of the detected temperature of the center of the detection object and the detected temperature of said each of the end portions of the detection object becomes lower than the other, a longer one of the time for which the power is supplied to the coil for the center of the detection object and the time for the power is supplied to said each of the coils for the end portions of the detection object is set to be shorter than the other.

5. The method according to claim 2, wherein in said each time period, when the time for the power is supplied to the other is set to a minimum time, the minimum time is equal to or longer than half a time period defined by an input power supply frequency.

6. The method according to claim 3, wherein in each of time periods, when a shorter one of time for the power is supplied to the coil for the center of the detection object and time for the power is supplied to said each of the coils for the end portions of the detection object is set to a minimum time, the minimum time is equal to or longer than half a time period defined by an input power supply frequency.

7. The method according to claim 4, wherein in said each time period, when the time for the power is supplied to the other is set to a minimum time, the minimum time is equal to or longer than half a time period defined by an input power supply frequency.

8. A apparatus for heating a heating member, for use in a fixing apparatus, comprising:

a heating member having a predetermined length in an axial direction of the heating member;

a first temperature detector which detects a temperature of a first portion of the heating member;

a second temperature sensor which detects a temperature of a second portion of the object which is located outward of the first portion in the axial direction of the heating member;

a first heating device which raises the temperature of the first portion of the object which is detected by the first temperature detector;

a second heating device which raises the temperature of the second portion of the object which is detected by the second temperature detector;

a temperature control device which supplies power having a predetermined frequency to the first heating device and the second heating device in each of time periods, and which enables time for which the power is supplied to the first heating device in said each time period and time for which the power is supplied to the second heating device in said each time period to be changed, wherein when the first temperature detector detects that the detected temperature of the first portion of the heating member is higher than a predetermined temperature, the temperature control device specifies which of the detected temperatures of the first and second portions of the heating member is higher, based on a result of detection by the first and second temperature detectors, and causes an amount of the power supplied to one of the first and second heating devices, which raises a lower one of the detected temperatures of the first and second portions of the heating member, to be larger than an amount of the power supplied to the other, the power being supplied to one and the other of the first and second heating devices asynchronously.

9. The apparatus according to claim 8, wherein the temperature control device changes the time for which the power is supplied to the first heating device and the time for which the power is supplied to the second heating device, to cause causes the amount of the power supplied to said one of the first and second heating devices to be larger than the amount of the power supplied to the other.

10. The apparatus according to claim 9, wherein the temperature control device controls the time for which the power is supplied to the first heating device and the time for which the power is supplied to the second heating device, by increasing the time for which the power is supplied to one of the first and heating devices in said each time period, and decreasing the time for which the power is supplied to the other in said each time period.

11. The apparatus according to claim 8, wherein when a higher one of the detected temperatures of the first and second portions of the heating member becomes lower than the other, the temperature control device causes a longer one of the time for which the power is supplied to the first heating device and the time for which the power is supplied to the second heating device to be shorter than the other.

12. The apparatus according to claim 10, wherein when a higher one of the detected temperatures of the first and second portions of the heating member becomes lower than the other, the temperature control device causes a longer one of the time for which the power is supplied to the first heating device and the time for which the power is supplied to the second heating device to be shorter than the other.

13. The apparatus according to claim 10, wherein when the temperature control device sets a shorter one of the time for the power is supplied to the first heating device in said each time period and the time for the power is supplied to the second heating device in said each time period to a minimum time, the minimum time is equal to or longer than half a time period defined by an input power supply frequency.

14. The apparatus according to claim 11, wherein when the temperature control device sets a shorter one of the time for the power is supplied to the first heating device in said each time period and the time for the power is supplied to the second heating device in said each time period to a minimum time, the minimum time is equal to or longer than half a time period defined by an input power supply frequency.

15. The apparatus according to claim 12, wherein when the temperature control device sets a shorter one of the time for the power is supplied to the first heating device in said each time period and the time for the power is supplied to the second heating device in said each time period to a minimum time, the minimum time is equal to or longer than half a time period defined by an input power supply frequency.

16. A apparatus for heating a heating member, for use in a fixing apparatus, comprising:

a heating member having a predetermined length in an axial direction of the heating member;

a first temperature detector which detects a temperature of a center of the heating member;

a second temperature detector which detects a temperature of an end portion of the heating object, which is located outward of the center of the heating member in the axial direction of the heating member;

a first heating device which raises the temperature of the center of the heating member;

a second heating device which raises the temperature of the end portion of the heating member; and a temperature control device which supplies current having a predetermined frequency to the first heating device and the second heating device in each of time periods, and which enables time for which the power is supplied to the first heating device in said each time period and time for which the power is supplied to the second heating device in said each time period to be changed, wherein when the first temperature detector detects that the temperature of the center of the heating member is higher than a predetermined temperature, the temperature control device specifies which of the temperatures of the center and end portion of the heating member is higher, based on a result of detection by the first and second temperature detectors, and causes an amount of the power supplied to one of the first and second heating devices, which raises a lower one of the detected temperatures of the center and end portions of the heating member, to be larger than an amount of the power supplied to the other, the power being supplied to one and the other of the first and second heating devices asynchronously.

* * * * *